US009696653B2

(12) United States Patent
Ikebata

(10) Patent No.: US 9,696,653 B2
(45) Date of Patent: Jul. 4, 2017

(54) DEVELOPING DEVICE AND IMAGE FORMING APPARATUS

(71) Applicant: KYOCERA Document Solutions Inc., Osaka-shi, Osaka (JP)

(72) Inventor: Yoshiaki Ikebata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/180,678

(22) Filed: Jun. 13, 2016

(65) Prior Publication Data

US 2016/0370729 A1 Dec. 22, 2016

(30) Foreign Application Priority Data

Jun. 17, 2015 (JP) ..... 2015-121862

(51) Int. Cl.
*G03G 15/08* (2006.01)
*G03G 21/20* (2006.01)

(52) U.S. Cl.
CPC ..... *G03G 15/0812* (2013.01); *G03G 21/206* (2013.01)

(58) Field of Classification Search
CPC ..... G03G 15/0808; G03G 15/0812
See application file for complete search history.

(56) References Cited

U.S. PATENT DOCUMENTS

2011/0229184 A1 9/2011 Kashimoto et al.

FOREIGN PATENT DOCUMENTS

JP 2011197285 A 10/2011

*Primary Examiner* — Erika J Villaluna
(74) *Attorney, Agent, or Firm* — Alleman Hall Creasman & Tuttle LLP

(57) ABSTRACT

A developing device includes a developer carrier, a thickness restricting portion, and an airflow rotor. The developer carrier rotates while carrying a developer on an outer circumferential surface thereof. The thickness restricting portion is disposed spaced apart from the developer carrier, and restricts the thickness of the two-component developer carried by the developer carrier. The airflow rotor is a rotor that rotates in a direction opposite to a rotation direction of the developer carrier, at a position spaced apart from an upper surface of the thickness restricting portion and from the outer circumferential surface of the developer carrier. The airflow rotor generates airflow in a space between the airflow rotor and the upper surface of the thickness restricting portion.

6 Claims, 3 Drawing Sheets

DEVELOPING DEVICE AND IMAGE FORMING APPARATUS

INCORPORATION BY REFERENCE

This application is based upon and claims the benefit of priority from the corresponding Japanese Patent Application No. 2015-121862 filed on Jun. 17, 2015, the entire contents of which are incorporated herein by reference.

BACKGROUND

The present disclosure relates to a developing device and an image forming apparatus.

Generally, in a developing device mounted on an electrophotographic type image forming apparatus, the thickness of a developer formed on a surface of a developer carrier is restricted by a thickness restricting portion. The thickness restricting portion is referred to as a doctor blade or a restriction blade.

There are cases where, in the developing device, toner contained in the developer floats and deposits on an upper surface of the thickness restricting portion. The toner deposited on the thickness restricting portion is likely to transfer from the thickness restricting portion to an image carrier, and may adversely affect the image quality.

Meanwhile, it is known that a mechanism for moving a sheet member is provided in the vicinity of the thickness restricting portion, in order to prevent the toner from depositing on the thickness restricting portion.

SUMMARY

A developing device according to one aspect of the present disclosure includes a developer carrier, a thickness restricting portion, and an airflow rotor. The developer carrier rotates while carrying a developer on an outer circumferential surface thereof. The thickness restricting portion is disposed spaced apart from the developer carrier, and restricts the thickness of the two-component developer carried by the developer carrier. The airflow rotor is a rotor that rotates in a direction opposite to a rotation direction of the developer carrier, at a position spaced apart from an upper surface of the thickness restricting portion and from the outer circumferential surface of the developer carrier. The airflow rotor generates airflow in a space between the airflow rotor and the upper surface of the thickness restricting portion.

An image forming apparatus according to another aspect of the present disclosure includes the developing device according to the one aspect of the present disclosure.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described in detail based on the drawings. It should be noted that the following embodiments are examples embodying the present disclosure, and, by nature, do not limit the technical scope of the present disclosure.

[Structure of Image Forming Apparatus 10]

First, the structure of an image forming apparatus 10 including developing devices 43 according to the first embodiment will be described with reference to FIG. 1. The image forming apparatus 10 is an electrophotographic type image forming apparatus.

Figure 1:
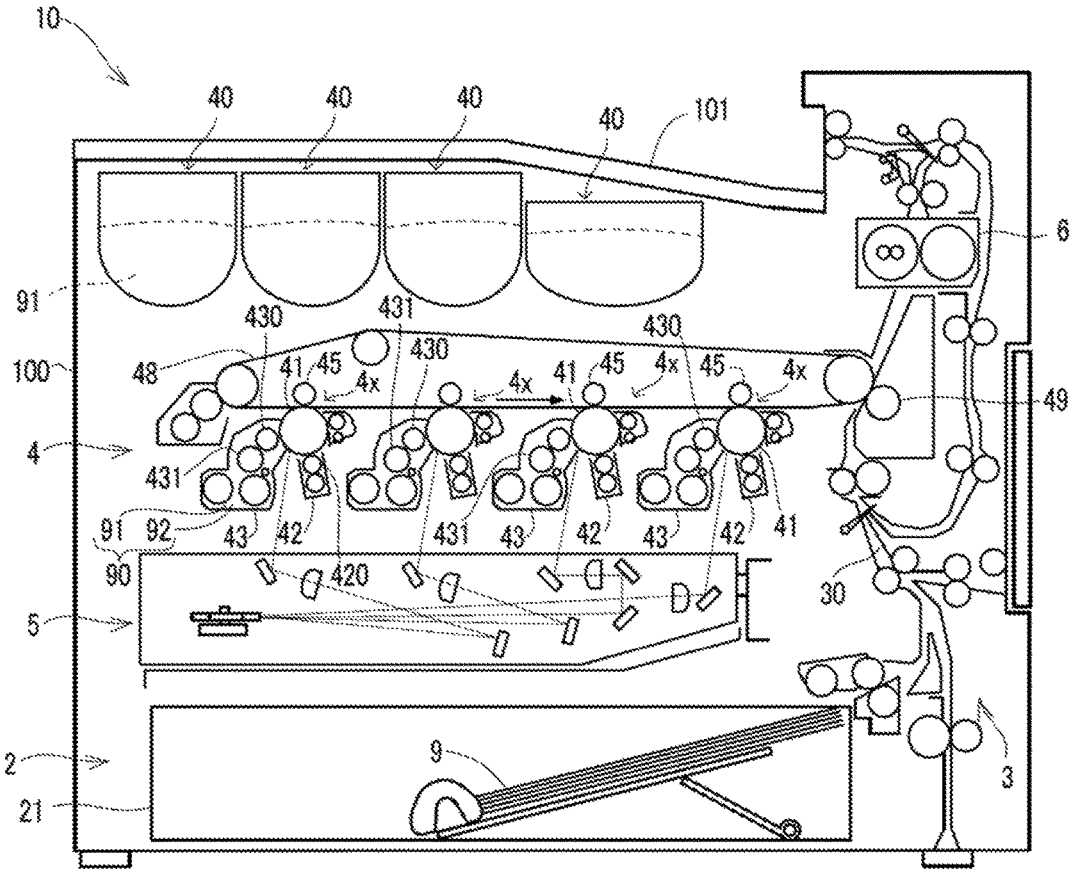
FIG. 1 illustrates a configuration of an image forming apparatus including developing devices according to a first embodiment.

As shown in FIG. 1, the image forming apparatus 10 includes, within a housing 100, a sheet feed portion 2, a sheet conveying portion 3, toner supply portions 40, an image forming portion 4, an optical scanning portion 5, and a fixing portion 6, etc.

The image forming apparatus 10 shown in FIG. 1 is a tandem-type image forming apparatus, and is a color printer. Thus, the image forming portion 4 further includes an intermediate transfer belt 48 and a secondary transfer device 49.

The image forming portion 4 also includes a plurality of single-color image forming portions 4*x* corresponding to colors of cyan, magenta, yellow, and black, respectively. The plurality of the toner supply portions 40 supply toners 91 of the respective colors to the developing devices 43.

The image forming apparatus 10 is, for example, a printer, a copy machine, a facsimile, a multifunction peripheral, or the like. The multifunction peripheral has the function of the printer, and the function of the copy machine, etc.

The sheet feed portion 2 feeds a sheet material 9 from a sheet receiving portion 21 toward a conveyance path 30. The sheet conveying portion 3 conveys the sheet material 9 fed from the sheet feed portion 2 toward the secondary transfer device 49 of the image forming portion 4, and discharges the sheet material 9 onto a discharge tray 101.

Each single-color image forming portion 4*x* forms an image of the corresponding color on the surface of the rotating intermediate transfer belt 48. Thus, a color image in which the images of the respective colors are superposed is formed on the intermediate transfer belt 48. The secondary transfer device 49 transfers the toner image formed on the intermediate transfer belt 48 to the sheet material 9.

Each single-color image forming portion 4*x* includes a photosensitive drum 41 that carries the toner image, a charging device 42, a developing device 43, and a primary transfer device 45, etc.

In each single-color image forming portion 4*x*, the photosensitive drum 41 rotates, and the charging device 42 uniformly charges the surface of the photosensitive drum 41.

Further, the optical scanning portion 5 performs scanning with laser light, thereby writing an electrostatic latent image on the charged surface of the photosensitive drum 41. The developing device 43 develops the electrostatic latent image by supplying the toner 91 to the photosensitive drum 41.

The developing device 43 agitates a developer 90 including the toner 91 and a carrier 92, to charge the toner 91, and supplies the charged toner 91 to the photosensitive drum 41. Thus, the electrostatic latent image formed on the surface of the photosensitive drum 41 is visualized as the toner image.

The carrier 92 is a magnetic granular substance. For example, the carrier 92 may be a granular material that includes a granular magnetic material and a synthetic resin film coating the surface of the magnetic material, such as epoxy resin.

The primary transfer device 45 transfers the toner image on the surface of the photosensitive drum 41, to the intermediate transfer belt 48.

The secondary transfer device 49 transfers the toner image on the surface of the intermediate transfer belt 48, to the sheet material 9 that travels in the conveyance path 30. The fixing portion 6 is a device for fixing the toner image onto the sheet material 9 by heating.

[First Embodiment: Developing Device 43]

Figure 2:
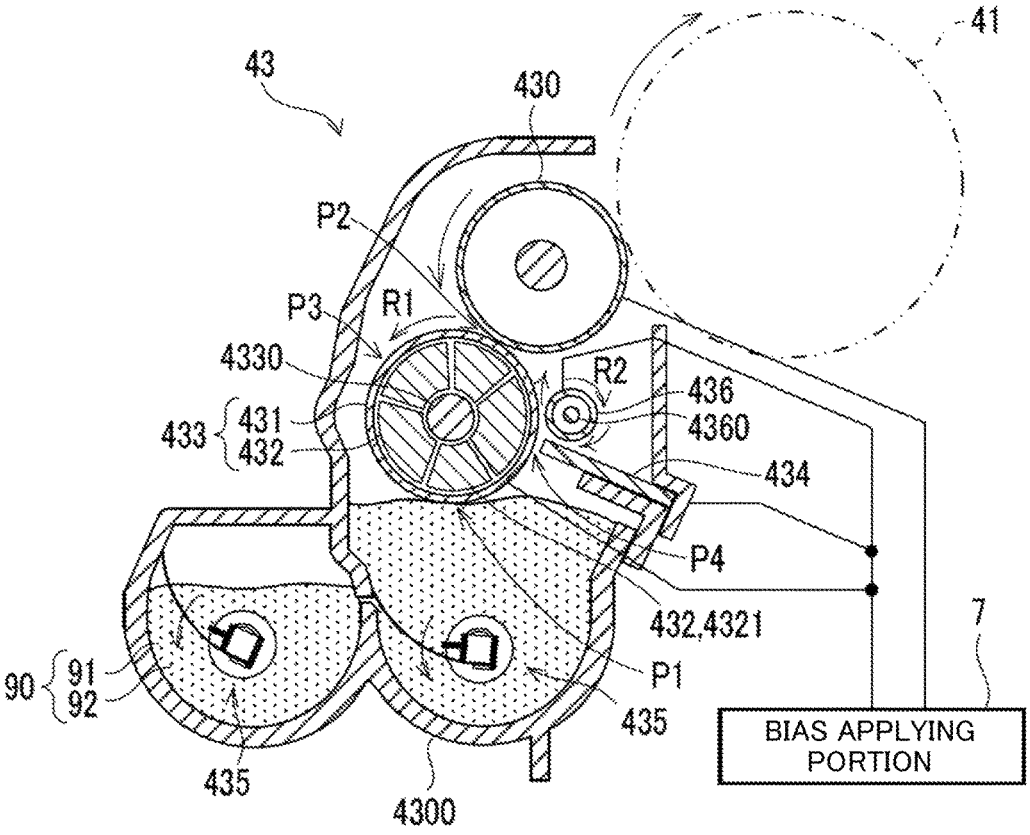
FIG. 2 is a cross-sectional view of each developing device according to the first embodiment.

As shown in FIG. 2, the developing device 43 includes a developer tank 4300, a developing roller 430, a rotation sleeve 431, magnets 432, a blade 434, and agitating mechanisms 435, etc. The magnets 432 and the rotation sleeve 431 that houses the magnets 432 constitute a magnetic roller 433. The rotation sleeve 431 is formed of a nonmagnetic substance.

The developer tank 4300 is a container in which the developer 90 is stored. The developing roller 430 and the rotation sleeve 431 are rotatably supported. The rotation sleeve 431 and the agitating mechanisms 435 are provided in the developer tank 4300.

Each agitating mechanism 435 is a mechanism that rotates in the developer tank 4300 to agitate the developer 90. The toner 91 is charged by being agitated.

The rotation sleeve 431 is a rotator that rotates while carrying the agitated developer 90 on its outer circumferential surface. The rotation sleeve 431 rotates in a first rotation direction R1 while carrying the developer 90. Thereby, the rotation sleeve 431 catches the developer 90 at a lower first position P1, and conveys the developer 90 to a third position P3 through a second position P2 facing the developing roller 430. The rotation sleeve 431 is an example of a developer carrier.

The rotation sleeve 431 supplies the toner 91 contained in the carried developer 90 to the developing roller 430 at the second position P2. That is, the rotation sleeve 431 rotates in the first rotation direction R1 while carrying, on the outer circumferential surface thereof, the developer 90 containing the toner 91 and the carrier 92, thereby supplying the toner 91 to the developing roller 430 at the second position P2.

The developing roller 430 rotates while carrying the toner 91 supplied from the rotation sleeve 431 on its outer circumferential surface. Thereby, the developing roller 430 supplies the toner 91 to a part corresponding to the electrostatic latent image on an outer circumferential surface of the photosensitive drum 41. Thus, the electrostatic latent image is developed as the toner image.

That is, the developing roller 430 is an example of a toner carrier that rotates while carrying the toner 91 on the outer circumferential surface thereof, thereby developing, with the toner, the electrostatic latent image formed on the photosensitive drum 41. The photosensitive drum 41 is an example of an image carrier having a surface on which the electrostatic latent image is formed.

The rotation sleeve 431 attracts and holds the carrier 92 from the first position P1 to the third position P3, by means of magnetism from the plurality of magnets 432 housed therein. A magnetic field formed by the plurality of magnets 432 causes the carrier 92 and the toner 91 attached to the periphery of the carrier 92 to be attached to the outer circumferential surface of the rotation sleeve 431.

Due to the effect of the magnetic field, the carrier 92 attached to the rotation sleeve 431 forms a magnetic brush that stands up from and is continuous over the outer circumferential surface of the rotation sleeve 431. The magnetic brush comes into contact with the outer circumferential surface of the developing roller 430 at the second position P2.

The developing device 43 includes a bias applying portion 7 that applies a bias voltage to between the developing roller 430 and the rotation sleeve 431. The polarity of the voltage at the rotation sleeve 431, based on the potential at the developing roller 430, is the same with respect to the charging polarity of the toner 91.

Due to the effect of the bias voltage, the charged toner 91 on the magnetic brush formed on the surface of the rotation sleeve 431 transfers to the developing roller 430. Further, the toner 91 on the surface of the developing roller 430 flies from the developing roller 430 to the part corresponding to the electrostatic latent image on the photosensitive drum 41, due to a potential difference between the developing roller 430 and the part corresponding to the electrostatic latent image on the photosensitive drum 41.

The developing device 43 including the rotation sleeve 431 and the developing roller 430 is a device that develops the electrostatic latent image on the surface of the photosensitive drum 41 by a so-called interactive touchdown method.

The blade 434 is provided, spaced apart from the rotation sleeve 431, at a fourth position P4 between the first position P1 and the second position P2 on the outer periphery of the rotation sleeve 431. Thereby, the blade 434 restricts the thickness of the developer 90 carried by the rotation sleeve 431. The blade 434 is an example of a thickness restricting portion. The fourth position P4 is a position on the upstream side in the first rotation direction R1, relative to the second position P2 facing the developing roller 430, on the outer periphery of the rotation sleeve 431.

Meanwhile, there is a need to prevent the toner 91 from depositing on the blade 434 in the electrophotographic type developing device 43, by use of a simpler structure.

The developing device 43 is capable of, by a simple structure, preventing the toner 91 from depositing on the blade 434 in the developing device 43. Hereinafter, the structure will be described.

Figure 3:
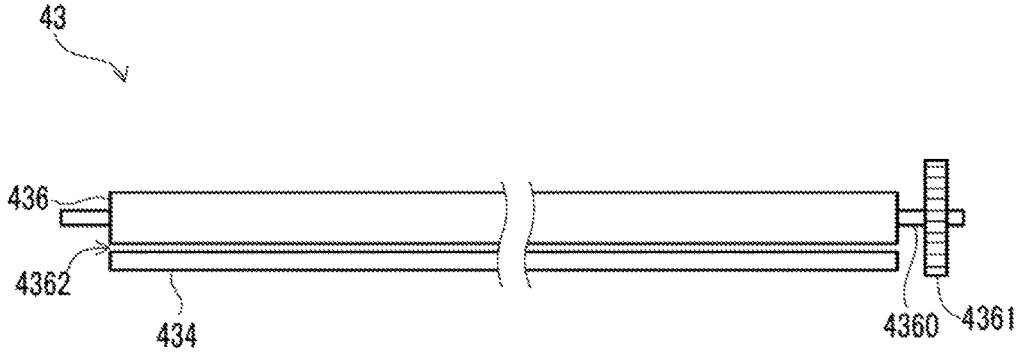
FIG. 3 is a vertical projection view of an airflow rotor and a blade which are included in the developing device according to the first embodiment.
Figure 4:
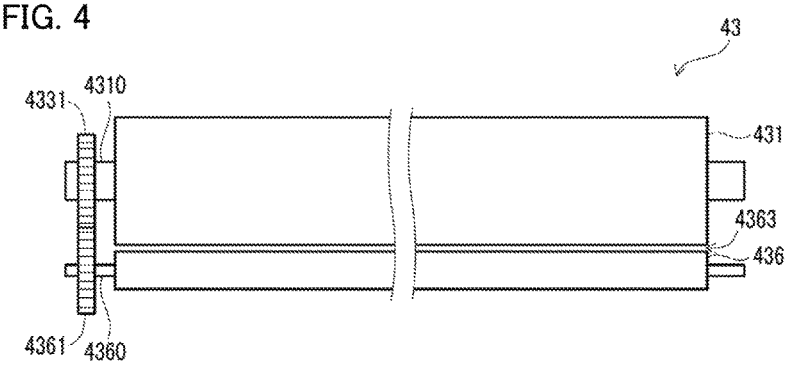
FIG. 4 is a vertical projection view of the airflow rotor and a rotation sleeve which are included in the developing device according to the first embodiment.

The developing device 43 includes an airflow rotor 436. As shown in FIGS. 2 to 4, the airflow rotor 436 is a rotator that rotates in a second rotation direction R2, at a position apart by spaces 4362 and 4363 from the upper surface of the blade 434 and the outer circumferential surface of the rotation sleeve 431, respectively. The second rotation direction R2 is a direction opposite to the first rotation direction R1.

As shown in FIG. 4, a first gear 4331 provided on a rotation shaft 4310 of the rotation sleeve 431 and a second gear 4361 provided on a rotation shaft 4360 of the airflow rotor 436 are engaged with each other. The first gear 4331 is driven by a motor (not shown) that drives the developing roller 430. Thereby, the airflow rotor 436 rotates in conjunction with the rotation sleeve 431.

In the present embodiment, the outer circumferential surfaces of the rotation sleeve 431 and the airflow rotor 436 are cylindrical in shape. Further, a part of the upper surface of the blade 434, facing the airflow rotor 436, is a flat surface. The first space 4362 between the outer circumferential surface of the airflow rotor 436 and the upper surface of the blade 434 and the second space 4363 between the outer circumferential surface of the airflow rotor 436 and the outer circumferential surface of the rotation sleeve 431 are uniform in the longitudinal direction of the airflow rotor 436.

For example, the dimension of the second space 4363 is equal to or slightly larger than the interval between the outer circumferential surface of the rotation sleeve 431 and a front end of the blade 434. It is conceivable that the first space 4362 and the second space 4363 have almost the same dimension.

Since the rotation sleeve 431 and the airflow rotor 436 rotate in opposite directions, the outer circumferential surface of the rotation sleeve 431 and the outer circumferential surface of the airflow rotor 436 rotate upward in the second space 4363. Thereby, in the second space 4363, airflow directed upward from the lower side near the first space 4362 is generated in the second space 4363. Further, a lower area in the second space 4363, i.e., an area near the first space 4362 in the second space 4363, has a negative pressure.

Accordingly, in the first space 4362, airflow directed to the second space 4363 is generated. That is, the airflow rotor 436 causes airflow in the first space 4362 between itself and the upper surface of the blade 434.

The airflow generated in the first space 4362 and the second space 4363 causes the floating toner to move with the airflow. As a result, the floating toner is prevented from depositing on the upper surface of the blade 434.

In the example shown in FIG. 2, the airflow rotor 436 has a cylindrical shape. However, it is also conceivable that the airflow rotor 436 has a rod-like shape which is not hollow.

The airflow rotor 436 is a conductor formed of a material such as a metal. The airflow rotor 436 is short-circuited with the blade 434 and the rotation sleeve 431. Therefore, a bias voltage of the same potential as that of the rotation sleeve 431 and the blade 434 is applied to the airflow rotor 436 by the bias applying portion 7.

Accordingly, disadvantages that may be caused by a potential difference between the airflow rotor 436 and the member in the vicinity of the airflow rotor 436 can be avoided. For example, the developer 90 carried by the rotation sleeve 431 is prevented from being adversely affected by the potential difference. In addition, the charged floating toner is prevented from being attracted by the airflow rotor 436.

Further, it is conceivable that the airflow rotor 436 is a member made of a non-magnetic substance, such as a member made of alumite as a main component. If the airflow rotor 436 is a non-magnetic member, the airflow rotor 436 is prevented from adversely affecting the carrier 92 in the developer 90 carried by the rotation sleeve 431. It is also conceivable that the airflow rotor 436 is a member made of a metal such as iron.

[Second Embodiment: Developing Device 43A]

Figure 5:
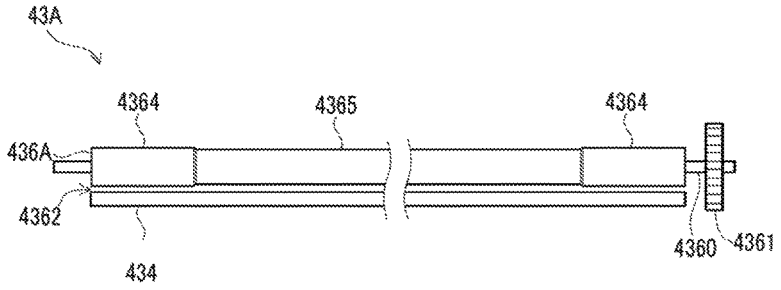
FIG. 5 is a vertical projection view of an airflow rotor and a blade which are included in a developing device according to a second embodiment.
Figure 6:
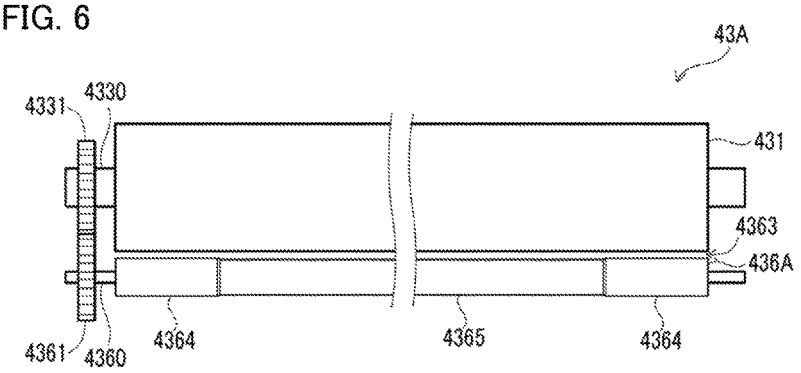
FIG. 6 is a vertical projection view of the airflow rotor and a rotation sleeve which are included in the developing device according to the second embodiment.

An airflow rotor 436A of a developing device 43A is different from the airflow rotor 436 in the shape of the outer circumferential surface. As shown in FIGS. 5 and 6, the outer circumferential surface of the airflow rotor 436A includes first outer circumferential surfaces 4364 and a second outer circumferential surface 4365.

The first outer circumferential surfaces 4364 are outer circumferential surfaces of both end portions of the airflow rotor 436A in the rotation axis direction. The second outer circumferential surface 4365 is an outer circumferential surface of a center portion of the airflow rotor 436 in the rotation axis direction.

In the airflow rotor 436A, the first outer circumferential surfaces 4364 are formed to have a larger diameter than the second outer circumferential surface 4365 of the center portion. Therefore, the first space 4362 and the second space 4363 are formed to be narrower in the area corresponding to the second outer circumferential surface 4365 than in the area corresponding to the first outer circumferential surfaces 4364.

Each of the first outer circumferential surface 4364 and the second outer circumferential surface 4365 has a cylindrical shape. Therefore, in the first space 4362, the space in the area along each of the first outer circumferential surfaces 4364 and the second outer circumferential surface 4365 is uniform. Likewise, also in the second space 4363, the space in the area along each of the first outer circumferential surfaces 4364 and the second outer circumferential surface 4365 is uniform.

In the airflow rotor 436A of the developing device 43A, the circumferential speed of the first outer circumferential surface 4364 is higher than that of the second outer circumferential surface 4365. Therefore, in the first space 4362 and the second space 4363, the airflow generated in the areas at the both end portions in the rotation axis direction is faster than the airflow generated in the center area.

Generally, the above-mentioned floating toner is likely to deposit on the upper surface of the blade 434 in the areas at the both ends portions of the rotation sleeve 431 in the rotation axis direction. In the present embodiment, however, the airflow having the relatively high flow rate is generated in the areas at the both end portions of the rotation sleeve 431 in the rotation axis direction. Thus, in the areas at the both end portions of the rotation sleeve 431 in the rotation axis direction, the floating toner is prevented more effectively from depositing on the upper surface of the blade 434.

[Application Examples]

It is also conceivable that the above-mentioned airflow rotor 436 or 436A is applied to a developing device adopting a two-component developing method. In the above-mentioned developing device adopting the two-component developing method, the rotation sleeve 431 housing the magnets 432 is a developer carrier that carries the two-component developer 90. In this case, the toner 91 contained in the developer 90 is transferred from the outer circumferential surface of the rotation sleeve 431 to the electrostatic latent image on the photosensitive drum 41.

The developing device and the image forming apparatus according to the present disclosure can be configured by freely combining the embodiments and application examples described above, or modifying or partially omitting the embodiments and the application examples as appropriate, within the scope of the disclosure recited in each claim.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer carrier configured to rotate while carrying a developer on an outer circumferential surface thereof;

a thickness restricting portion disposed spaced apart from the developer carrier, and configured to restrict a thickness of the developer carried by the developer carrier; and an airflow rotor configured to rotate in a direction opposite to a rotation direction of the developer carrier, at a position spaced apart from an upper surface of the thickness restricting portion and from the outer circumferential surface of the developer carrier, thereby to generate airflow in a space between the airflow rotor and the upper surface of the thickness restricting portion, wherein the airflow rotor is a conductor, and a bias voltage of the same potential as that of the developer carrier and the thickness restricting portion is applied to the airflow rotor.

2. The developing device according to claim 1, wherein first outer circumferential surfaces of both end portions of the airflow rotor in a rotation axis direction are formed to have a larger diameter than a second outer circumferential surface of a center portion of the airflow rotor in the rotation axis direction.

3. The developing device according to claim 2, wherein each of the first outer circumferential surfaces and the second outer circumferential surface has a cylindrical shape.

4. The developing device according to claim 1, wherein the airflow rotor is a non-magnetic substance.

5. The developing device according to claim 1, further including a toner carrier configured to rotate while carrying, on an outer circumferential surface thereof, toner supplied from the developer carrier that carries a two-component developer containing the toner and a carrier, and supply the toner to an electrostatic latent image on an image carrier.

6. An image forming apparatus including the developing device according to claim 1.

* * * * *